US005450102A

United States Patent [19]

Ishida et al.

[11] Patent Number: 5,450,102

[45] Date of Patent: Sep. 12, 1995

[54] RECORDING APPARATUS WITH MEANS FOR REMOVING PAPER CURL

[75] Inventors: Yasushi Ishida, Tokyo; Minoru Yokoyama, Yokohama; Takashi Awai, Yokohama; Akihiro Tomoda, Yokohama; Masakatsu Yamada, Yokohama, all of Japan

[73] Assignee: Canon Kabushiki Kaisha, Tokyo, Japan

[21] Appl. No.: 308,964

[22] Filed: Sep. 20, 1994

Related U.S. Application Data

[63] Continuation of Ser. No. 60,723, May 13, 1993, abandoned, which is a continuation of Ser. No. 555,591, Jul. 23, 1990, abandoned.

[30] Foreign Application Priority Data

Jul. 24, 1989 [JP] Japan ..... 1-188874

[51] Int. Cl.[6] ..... B41J 15/00

[52] U.S. Cl. ..... 346/136; 400/613.3

[58] Field of Search ..... 346/76 PH, 136; 400/613.3, 692, 693, 690.4, 619, 719

[56] References Cited

U.S. PATENT DOCUMENTS

| | | | |
|---|---|---|---|
| 3,630,614 | 12/1971 | Kazle et al. | 355/100 |
| 4,926,358 | 5/1990 | Tani et al. | 364/562 |
| 5,057,930 | 10/1991 | Curley | 346/136 |

FOREIGN PATENT DOCUMENTS

| | | | |
|---|---|---|---|
| 0086661 | 8/1983 | European Pat. Off. . | |
| 0095177 | 6/1984 | Japan . | |
| 60-245574 | 12/1985 | Japan . | |
| 0123558 | 6/1986 | Japan | 400/613.3 |
| 0139470 | 6/1986 | Japan | 400/692 |
| 175377 | 8/1987 | Japan . | |
| 0139754 | 6/1988 | Japan | 400/690.4 |
| 0199669 | 8/1988 | Japan | 400/690.4 |
| 2171082 | 8/1986 | United Kingdom . | |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A recording apparatus has an apparatus body, a lid member openable and closable relative to the apparatus body, decurling means having a decurling member pivotably provided in the lid member and a guide member provided in the apparatus body, the decurling means guiding a recording sheet being conveyed so as to be bent in the direction opposite to the direction of curl of the recording sheet by the decurling member and the guide member, ink sheet cartridge loading means for loading an ink sheet cartridge containing an ink sheet therein between the decurling member and the lid member, and recording means for recording images on the recording sheet.

10 Claims, 10 Drawing Sheets

RECORDING APPARATUS WITH MEANS FOR REMOVING PAPER CURL

This application is a continuation of application Ser. No. 08/060,723 filed May 13, 1993 abandoned, which is a continuation of application Ser. No. 07/555,591 filed Jul. 23, 1990 abandoned.

BACKGROUND OF THE INVENTION

1. Field of the Invention

This invention relates to a recording apparatus which can be loaded with an ink sheet cartridge provided with an ink sheet.

The term "recording apparatus" used herein covers, for example, a facsimile apparatus, an elecitronic typewriter, a copying apparatus, a printer apparatus, etc.

2. Related Background Art

Today, facsimile apparatuses have come to be widely used not only in offices, but also in homes. Therefore, compactness has been desired for facsimile apparatuses and the thermal recording system which can be readily made compact has been adopted as the recording system. The thermosensitive recording system using a thermosensitive sheet is generally used as the heat recording system, but in recent years, there has also been developed a facsimile apparatus of the so-called heat transfer recording type which can use plain paper.

The heat transfer recording system is such that the apparatus is loaded with a recording sheet roll comprising a substantial length of recording sheet wound on a core, and an ink sheet comprising a thin film having heat-meltable ink applied thereto, and the ink sheet is selectively heated by a recording head and melted ink is transferred to the recording sheet to thereby form images thereon.

In the heat transfer recording system described above, the ink sheet is very thin and therefore easily becomes wrinkled, and it requires much time and labor to load the apparatus body with the ink sheet without wrinkling the ink sheet. Also, the recording sheet, which is wound in the form of a roll, tends to become curled and if the recording sheet as it is curled is conveyed, a paper jam or the like will be liable to occur.

So, it has been conceived that as shown, for example, in FIG. 3 of the accompanying drawings, an ink sheet 51 wound on a supply reel 50*a* and a take-up reel 50*b* is contained in a cartridge 52, which is made insertable into a lid member 53 to thereby facilitate the loading of the apparatus with the ink sheet 51.

Further, as the background art of the present invention, it has been conceived that as shown in FIG. 13, a decurling shaft 54 is mounted at the lower end of the cartridge 52 and the drive force of a platen motor 56 for driving a platen roller 55 is transmitted through a slide clutch 57 and an arm 58 rotatable in the direction of the arrow is mounted on the apparatus body 59 and a guide shaft 60 is mounted on one end of the arm 58 to thereby constitute a decurling mechanism. This decurling mechanism is such that when recording is to be effected by a recording head 62 with the ink sheet 51 and a recording sheet 61 being conveyed, the arm 58 is rotated and the recording sheet 61 is guided by the guide shaft 60 and the decurling shaft 52 to thereby bend the recording sheet 61 in the direction opposite to the curl inherent therein, thus curing the recording sheet 61 of the curl.

In the above-described construction, however, the loading of the apparatus body 59 with the ink sheet cartridge 52 is effected with the lid member 53 being opened at an angle substantially approximate to the vertical with respect to the apparatus body 59 and therefore, this makes it difficult to mount the ink sheet cartridge 52 accurately on a positioning member formed in the lid member 53.

As regards the decurling mechanism, the decurling shaft 52 is mounted on the ink sheet cartridge 52 and therefore, it depends on the dimensional accuracy of the ink sheet cartridge 52 to provide the positional accuracy of the decurling shaft 54 relative to the apparatus body 59, particularly the degree of parallelism of the decurling shaft to the platen roller 55. This may increase the cost of the ink sheet cartridge 52.

SUMMARY OF THE INVENTION

It is an object of the present invention to provide a recording apparatus markedly improved in operability.

It is another object of the present invention to provide a recording apparatus markedly improved in the quality of image possible.

It is still another object of the present invention to provide a recording apparatus improved in the operation of loading the recording apparatus with an ink sheet cartridge provided with an ink sheet.

It is yet still another object of the present invention to provide a recording apparatus in which a recording sheet can be cured of its curl.

It is a further object of the present invention to solve the problems peculiar to the above-described background art and to provide a recording apparatus which can be easily loaded with an ink sheet cartridge and which enables the ink sheet cartridge to be manufactured at a low cost and in which a recording sheet can be cured of its curl.

DESCRIPTION OF PREFERRED EMBODIMENTS

Some embodiments of the present invention as incorporated in a facsimile apparatus will hereinafter be described by way of example.

[First Embodiment ]

Figure 1:
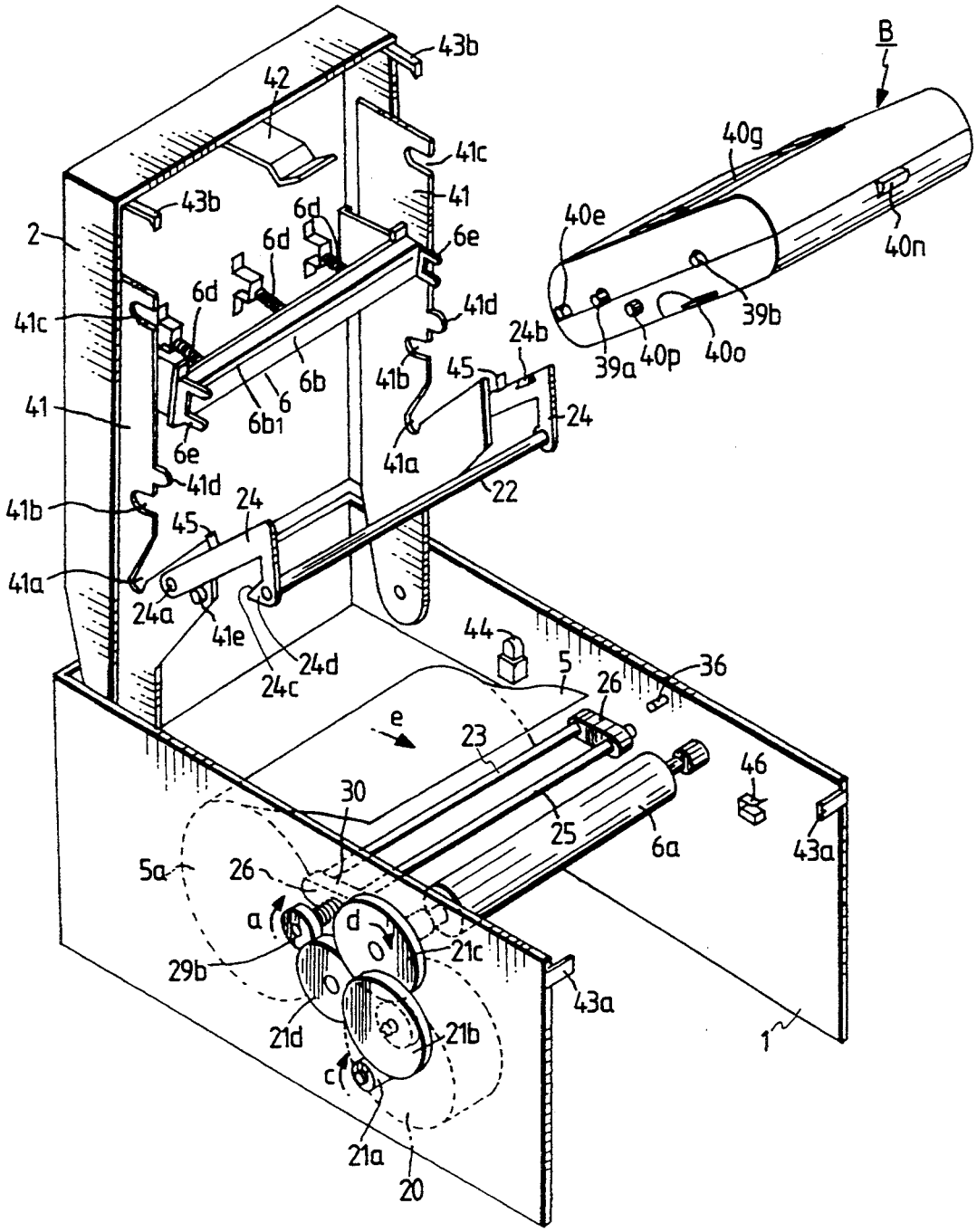
FIG. 1 is a perspective view showing the construction of a recording apparatus which is an embodiment of the present invention.
Figure 2:
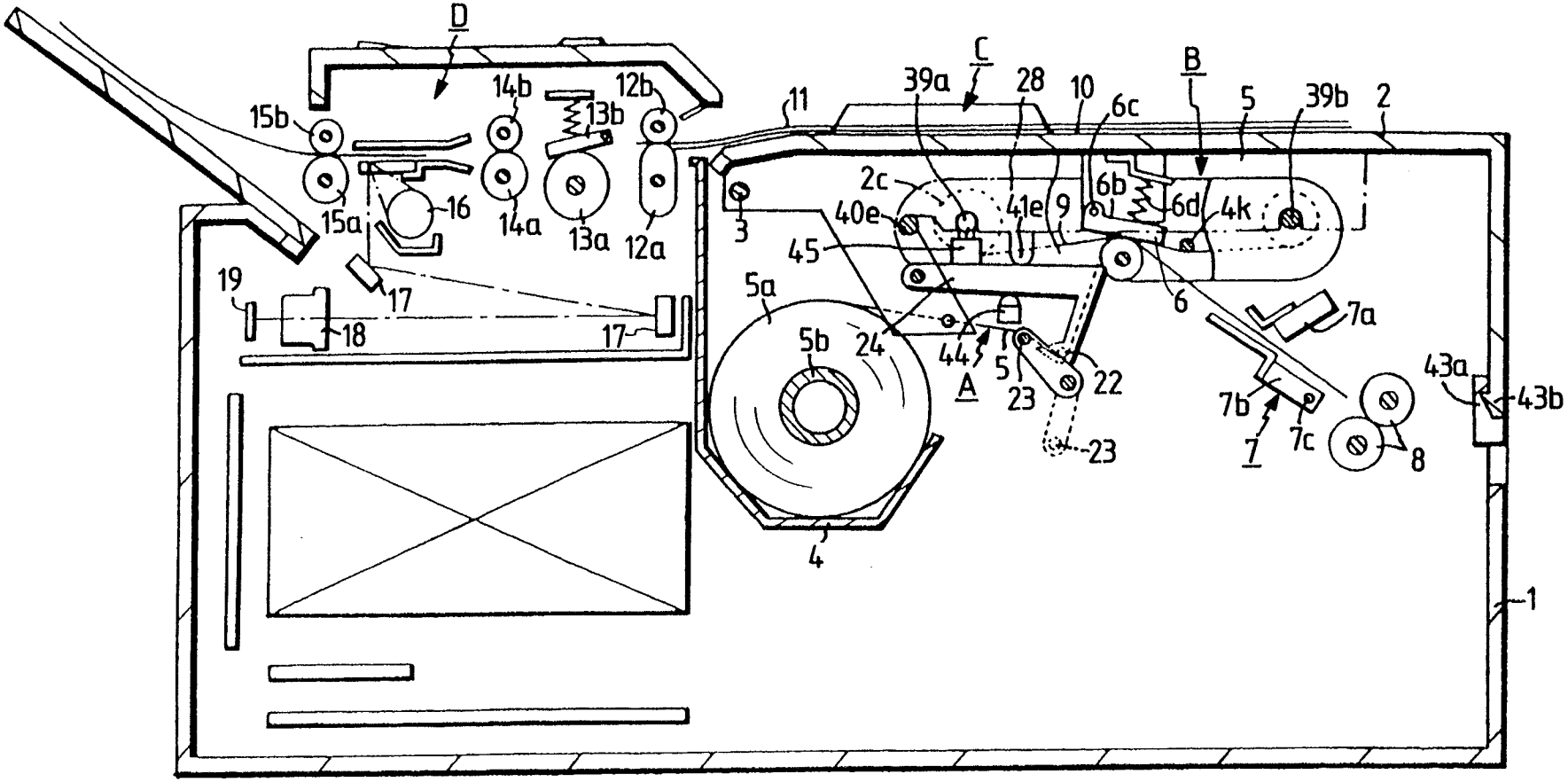
FIG. 2 is a general cross-sectional view of a facsimile apparatus.

FIG. 1 is a perspective view of a recording apparatus, and FIG. 2 is a general cross-sectional view of a facsimile apparatus using said recording apparatus as a recording system.

This facsimile apparatus, as shown in FIG. 2, includes a recording system C having a decurling mechanism A and an ink sheet cartridge (hereinafter referred to as the ink cartridge) B, and an original reading system D.

The general construction of this facsimile apparatus will first be broadly described with reference to FIG. 2. In the recording system C, a lid member 2 is designed to be openable and closable relative to the apparatus body 1 by a shaft 3, and is also designed to be capable of being restrained on the body 1 by at catch or click mechanism, not shown. The lid member 2 is removably loaded with the ink cartridge 13 containing an ink sheet 9 therein. A roll holder 4 is provided at a predetermined location in the body 1, and a roll 5*a* of a recording sheet 5 wound in the form of a roll is removably inserted in the roll holder 4. This recording sheet 5 is conveyed by the rotation of a platen roller 6*a* which constitutes conveying means, and is bent in the direction opposite to the direction of curl when it passes through the decurling mechanism A, whereby the recording sheet is cured of its curl.

The ink of the ink sheet 9 is selectively transferred to the recording sheet 5 cured of its curl in recording means 6, whereby an image is formed on the recording sheet 5. After the recording, the recording sheet 5 is cut by a cutter 7 and discharged by discharge rollers 8.

On the other hand, in the original reading system D, a plurality of originals 11 are set on an original supporting table 10 formed on the upper surface of the lid member 2, and when the reading operation is started, some of the bottommost originals 11 are conveyed by a preliminary conveying roller 12*a* and a pressure contact roller 12*b* urged thereagainst, and are separated and supplied one by one by a separating roller 13*a* and a pressure contact member 13*b* urged thereagainst. The separated original 11 is illuminated by a light source 16 as it is conveyed by pairs of conveying rollers 14*a*, 14*b* and 15*a*, 15*b*. The reflected light from the original passes to a photoelectric conversion element 19 such as a CCD via a mirror 17 and a lens 18 and is thereby. converted into an electrical signal, which, when the device is in copier mode, is transmitted to the recording system C of the device, and in the case when the device is in facsimile mode, is transmitted to the recording system an other apparatus.

The Construction of the various portions of the recording system C will now be described in detail.

The roll holder 4 is formed into an open-topped shape and is disposed in the apparatus body 1. The roll holder 4 is loaded with the sheet roll 5*a*, and because the outer peripheral surface of this roll 5*a* is in contact with the inner surface of the holder 4, there is frictional resistance therebetween. That is, if the roll 5*a* is large in diameter and heavy in weight, when the recording sheet 5 is drawn out, there is produced great frictional resistance, and as the recording sheet 5 is drawn out and the weight of the roll 5*a* is decreased, the frictional resistance also decreases. This frictional resistance has the effect of applying tension to the recording sheet 5 when drawn out, and the tension exerted on the recording sheet 5 as it is drawn out also varies in proportion to the magnitude of the frictional resistance.

Description will now be made of a recording head 6 and platen roller 6*a* for recording a predetermined image on the recording sheet 5. First, the platen roller 6*a* is a material having a high coefficient of friction such as hard rubber formed into the shape of a roller and rotatably mounted in the apparatus body 1. This platen roller is driven by a platen motor 20 which is a drive source. That is, as shown in FIG. 1, the rotational force of the motor 20 is transmitted from a gear 21*a* secured to the motor shaft through an intermediate gear 21*b* to a gear 21*c* secured to the roller shaft of the platen roller 6*a*, whereby the platen roller 6*a* is rotated. The recording sheet 5 is conveyed by the rotation of the platen roller 6*a*, that is, the platen roller 6*a* serves also as conveying means for the recording sheet 5.

The recording head 6 heats the ink sheet 9 in conformity with an image signal to thereby form an image on the recording sheet 5. It is urged against the platen roller 6*a* with the ink sheet 9 and the recording sheet 5 interposed therebetween. Specifically, the recording head 6 is pivotably mounted on the lid member 2 by means of a shaft 6*c*, and is urged against the platen roller 6*a* by a compression spring 6*d* when the lid member 2 is closed. Accordingly, when the platen roller 6*a* is rotated with the recording sheet 5 inserted between the platen roller 6*a* and the recording head 6, the recording sheet 5 is conveyed.

The recording head 6 in the present embodiment is a so-called line type thermal head in which number of heat generating elements $6b_1$, generate heat by being electrically energized and are transversely arranged on the surface for contact across the width of the recording sheet 5. So, by the heat generating elements $6b_1$, being electrically energized in conformity with an image signal, the recording head 6 selectively heats the ink sheet 9 and causes the ink of the ink sheet 9 to be transferred to the recording sheet 5, thereby accomplishing recording.

Next, the cutter 7 used in the present embodiment is a rotatable type cutter a fixed cutting edge 7*a* and a driving cutting edge 7*b*. More specifically the joined cutting edge 7*a* is fixed to the body 1 and the driving cutting edge 7*b* is mounted for pivotal movement about a shaft 7*c*. When the driving cutting edge 7*b* pivotally moved by driving means, it engages with the fixed cutting edge 7*a* to thereby cut the recording sheet 5.

The driving cutting edge 7*b* may be designed to be driven by the motor 20 for driving the platen roller 6*a*, or may be designed to be driven by another independent motor.

The recording sheet 5 cut by the cutter 7 is discharged by discharge rollers 8 driven by driving means (not shown). However, since the recording sheet 5 used for recording is wound on the core 5*b*, it is curled after it has been drawn out from the sheet roll 5*a*, the severity of this curl differs depending on the diameter of the roll 5*a*. For example, the curl created when the diameter of the roll 5*a* is large is slight, and the curl becomes more severe as the diameter of the roll decreases, and when the curl is extremely severe severe, the recording sheet 5 becomes round.

So, in the apparatus of the present embodiment, the recording sheet 5 is cured of such curl when it passes through the decurling mechanism A. That is, a guide shaft 23 is designed such that its position is movable relative to a decurling shaft 22. The recording sheet 5 when guided by the two shafts 22 and 23 is bent in the direction opposite to the direction of curl, whereby the recording sheet is cured of its curl.

Figure 3:
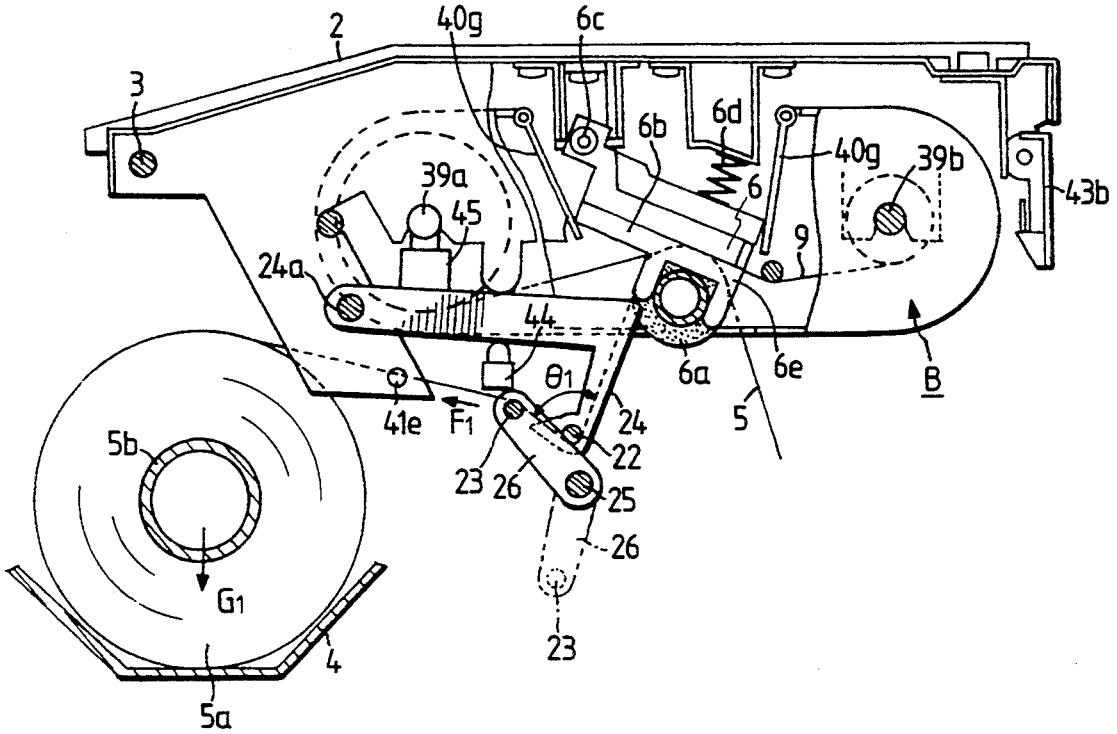
FIG. 3 illustrates a state in which recording is effected with the apparatus being loaded with a large-diametered sheet roll.
Figure 4:
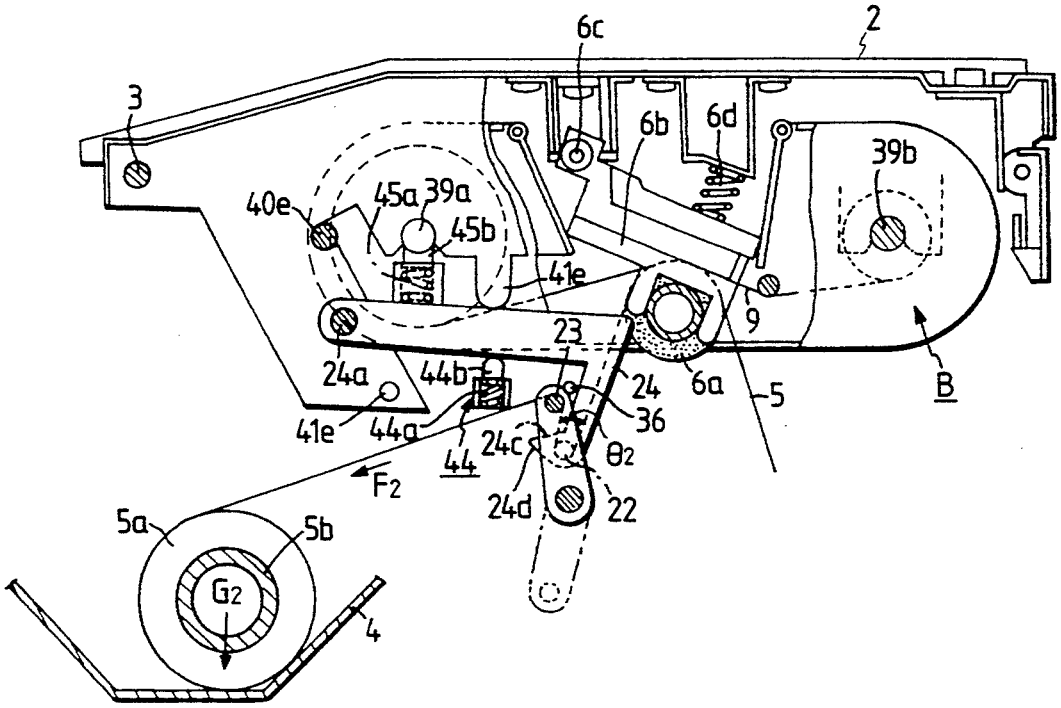
FIG. 4 illustrates a state in which recording is effected with the apparatus being loaded with a small-diametered sheet roll.

Also, the guide shaft 23 is biased against the recording sheet 5 by biasing means which will be described later so that the decurling effect may differ between a case where a large-diametered roll 5*a* as shown in FIG. 3 is mounted and a case where a small-diametered roll 5*a* as shown in FIG. 4 is mounted.

The construction of the decurling mechanism A will now be specifically described.

The decurling shaft 22, as shown is FIG. 1, is pivotably mounted on hook-shaped decurling holding members 24 mounted on the opposite ends of the lid member 2 for pivotal movement about shafts 24*a*. The spacing between the two decurling holding members 24 is greater than the width of the ink cartridge B which will be described later and smaller than the spacing between arms for supporting the opposite ends of the guide shaft 23.

The tip end of each of the decurling holding members 24 is formed into a tapered shape so that the decurling shaft 22 will not interfere with the guide shaft 23.

On the other hand, the guide shaft 23 is designed so as to be movable relative to the decurling shaft 22 by moving means. The construction of this moving means is such that as shown in the perspective. view of FIG. 5 and the cross-sectional view of FIG. 6, two arms 26 are secured to a shaft 25 mounted on the body 1 and the guide shaft 23 is rotatably mounted on the tip ends of the two arms 26. Rotation of the shaft 25 causes rotation of the arms 26, whereby the guide shaft 23 is movable relative to the decurling shaft 22.

Figure 6:
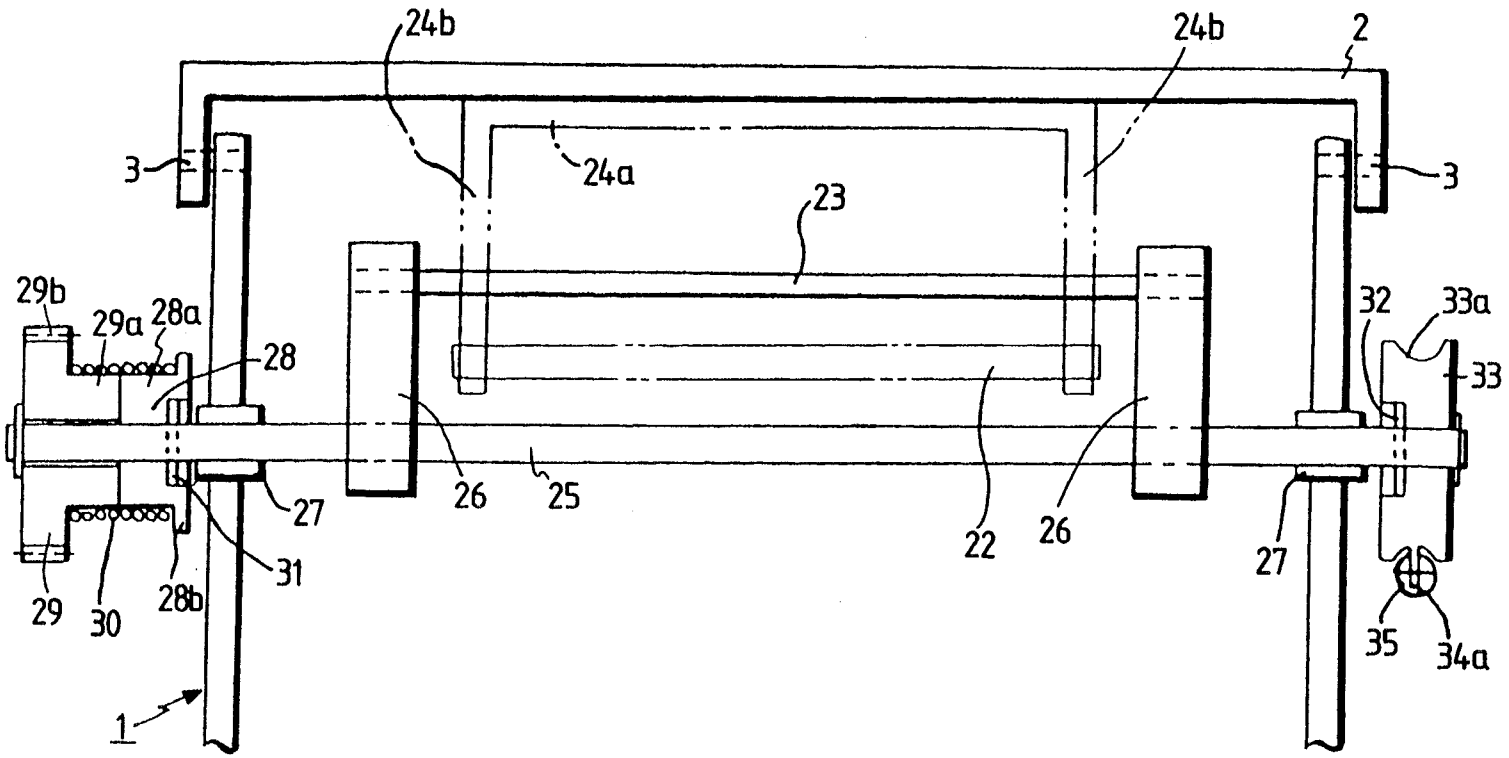

The shaft 25, as shown in FIG. 6, is rotatably mounted on the body 1 through bearings 27, and a clutch flange 28, a clutch gear 29 and a spring clutch 30 are mounted on one end of this shaft so that a rotational force in one direction may be transmitted to the shaft 25.

The clutch flange 28 comprises a cylindrical portion 28*a* and a flange portion 28*b*, and is mounted by means of a key pin 31 so as to be rotated with the shaft 25 in the same direction as the latter.

Also, the clutch gear 29 comprises a cylindrical portion 29*a* and a gear portion 29*b*, and the inner diameter of a hole into which the shaft 25 is inserted is made somewhat larger than the outer diameter of the shaft 25, and the clutch gear is mounted for rotation relative to the shaft 25.

The spring clutch 30 comprises a spring made from steel wire, a steel strip or a plastic wire wound into the form of a coil, and is wound over the outer periphery of the cylindrical portions 28*a* and 29*a* of the clutch flange 28 and the clutch gear 29, respectively, and one end thereof is restrained by the flange portion 28*b* of the clutch flange 28.

The spring clutch 30 transmits the rotational force of the clutch gear 29 to the clutch flange 28 only in one direction, and not in the other direction. That is, when the clutch gear 29 is rotated in the direction of arrow a in FIG. 5, the spring clutch 30 becomes loose and free and thus, the rotational force is not transmitted to the clutch flange 28. On the other hand, when the clutch gear 29 is rotated in the direction of arrow -a opposite to the direction of arrow a, the spring clutch 30 tightens the cylindrical portions 28*a* and 29*a* to thereby bring about a locked condition, whereby the rotational force is transmitted to the clutch flange 28 and a rotational force for moving the guide shaft 22 in the direction of arrow b is transmitted.

The drive source for rotating the clutch gear 29 is the same as the drive source for rotating the platen roller 6*a*, and is driven by the motor 20. That is, as shown in FIG. 1, the drive force of the motor 20 is transmitted to the platen roller 6*a* through the gears 21*a*–21 as previously described, and the gear 21*c* mounted on the shaft of the platen roller is in meshing engagement with the gear portion 29*b* of the clutch gear 29 through an intermediate gear 21*d*.

Accordingly, when as shown in FIG. 1, the motor 20 rotates in the direction of arrow c, the platen roller 6*a* is rotated in the direction of arrow d and the clutch gear 29 is rotated in the direction of arrow a. That is, when the platen roller 6*a* is rotated in a direction to draw out the recording sheet 5 in the direction of arrow e, the spring clutch 30 becomes free.

Figure 5:
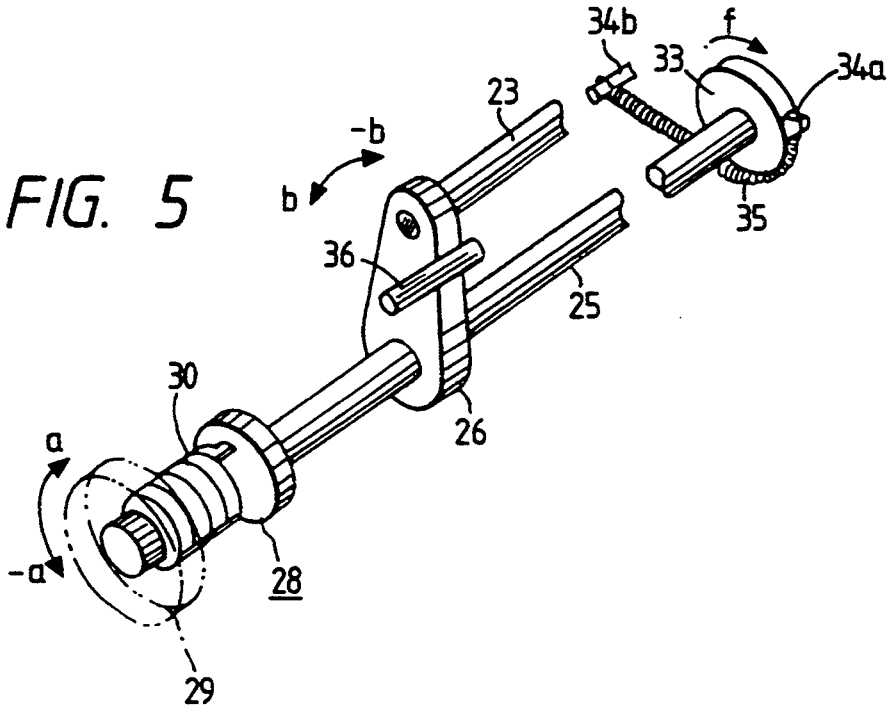
FIGS. 5 and 6 illustrate the construction of a decurling mechanism.
Figure 13:
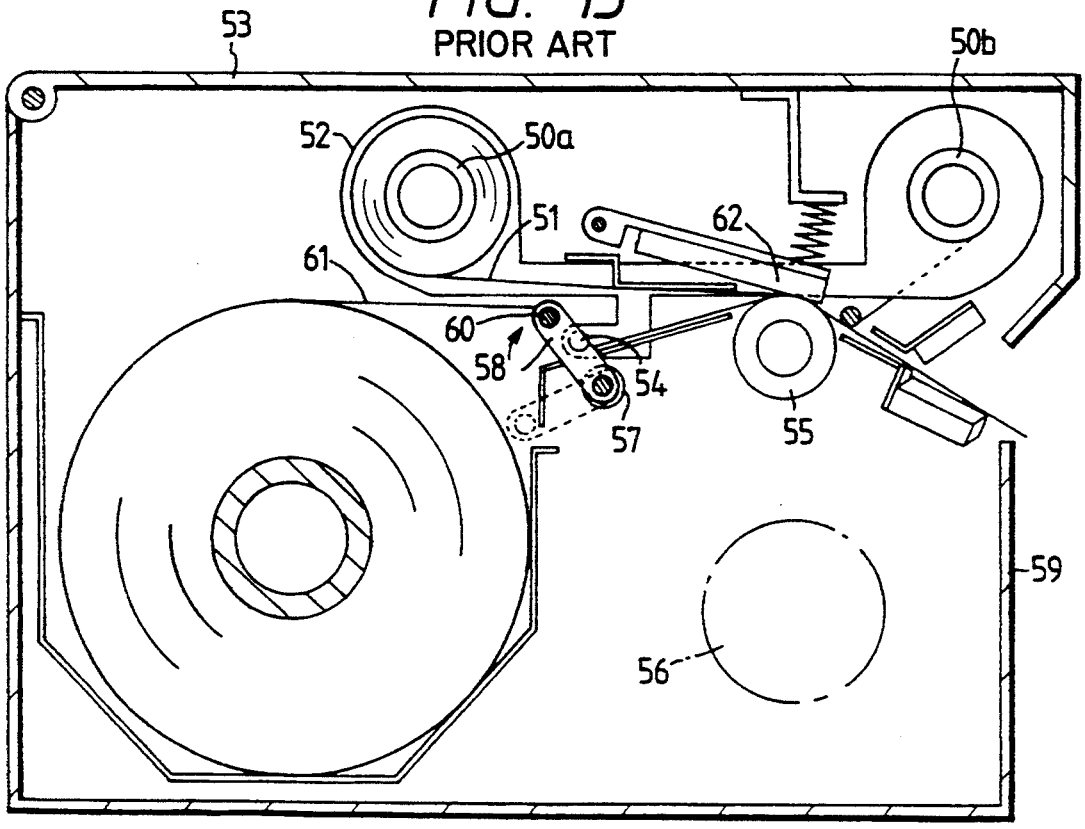
FIG. 13 PRIOR ART
FIG. 13 illustrates the background art.

Also, when the motor 20 rotates in the direction opposite to the direction of arrow c, the platen roller 6a is rotated in a direction to convey the recording sheet 5 in the reverse direction and at this time, the clutch gear 29 is rotated in the direction opposite to the direction of arrow a and thus, the spring clutch 30 becomes locked and transmits a rotational force for rotating the guide shaft 23 in the direction of arrow b in FIG. 5.

Description will now be made of the construction of biasing means for biasing the guide shaft 23 so as to be balanced with the tension of the recording sheet 5.

As shown in FIGS. 5 and 6, a pulley 33 is secured to the other end of the shaft 25 by means of a key pin 32. A groove 33*a* is formed in the circumferential surface of the pulley 33, and a hook 34*a* is projectedly provided at a predetermined location on the circumference of the pulley 33, and a tension spring 35 is mounted with tension between the hook 34*a* and a hook 34*b* projectedly provided at a predetermined location on the body 1. That is, under the tensile force of the tension spring 35, the pulley 33 is normally biased in the direction of arrow f in FIG. 5 ( a direction in which the decurling effect of the guide shaft 23 becomes greater).

Also, a stopper 36 is provided at a predetermined location on the body 1 within the range of rotation of the arm 26. This stopper is contacted by the arm 26 when the arm 26 is rotated in the direction of arrow -b in FIG. 5, and serves to limit the movement of the arm 26 and set the maximum value of the amount of turn of the recording sheet 5 relative to the decurling shaft 22.

Description will now be specifically made of the construction of the ink cartridge B inserted into the lid member 2.

Figure 7:
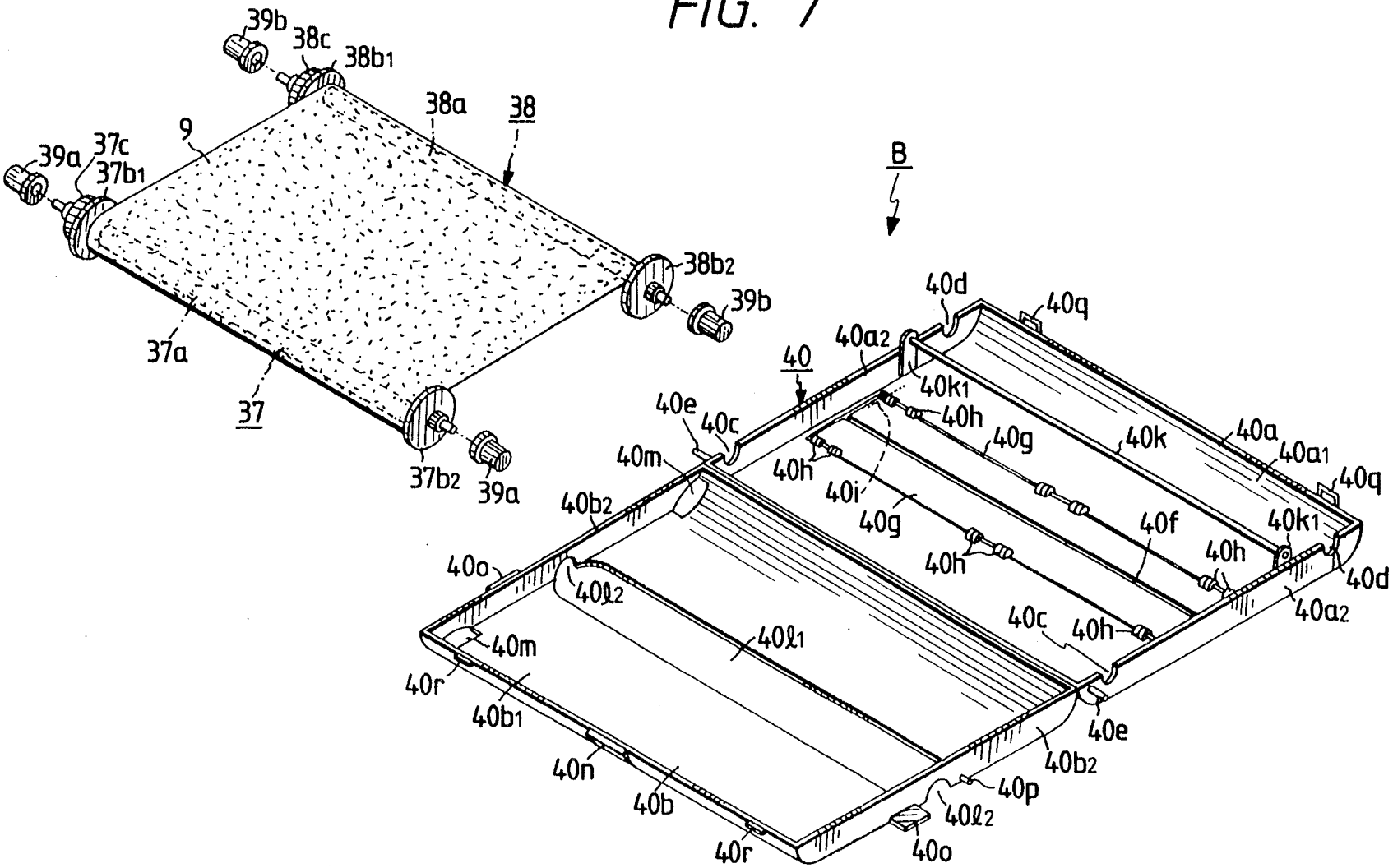
FIGS. 7 to 10 illustrate the construction of an ink sheet cartridge.

This ink cartridge B is such that as shown in FIG. 7, one end of the ink sheet 9 having heat-transferable (heat meltable or heat sublimable) ink applied to a substantial length of support film, which is wound on a supply reel 37 and the other end of the ink sheet 9 is wound on a take-up reel The supply reel 37 and the take-up reel 38 are such that as shown in FIG. 7, flanges $37b_1$, $37b_2$, $38b_1$ and $38b_2$ are provided on the opposite ends of reel shafts 37*a* and 38*a*. Also, reel gears 37*c* and 38*c* are formed integrally with the flanges $37b_1$ and $38b_1$ of the reels 37 and 38, respectively.

Further, the opposite ends of the reel shafts 37*a* and 38*a* are designed to protrude outwardly of the gears 37*c*, 38*c* and flanges $37b_2$, $38b_2$, and bearings 39*a* and 39*b* are provided so as to rotatably fit to the opposite ends of the reel shafts 37*a* and 38*a*.

The reels 37 and 38 on which the ink sheet 9 is wound are contained in a container The container 40, as shown in FIG. 7, has a first housing 40*a* and a second housing 40*b* pivotally connected together by a hinge, not shown, whereby the container. is made openable and closable.

Figure 8:
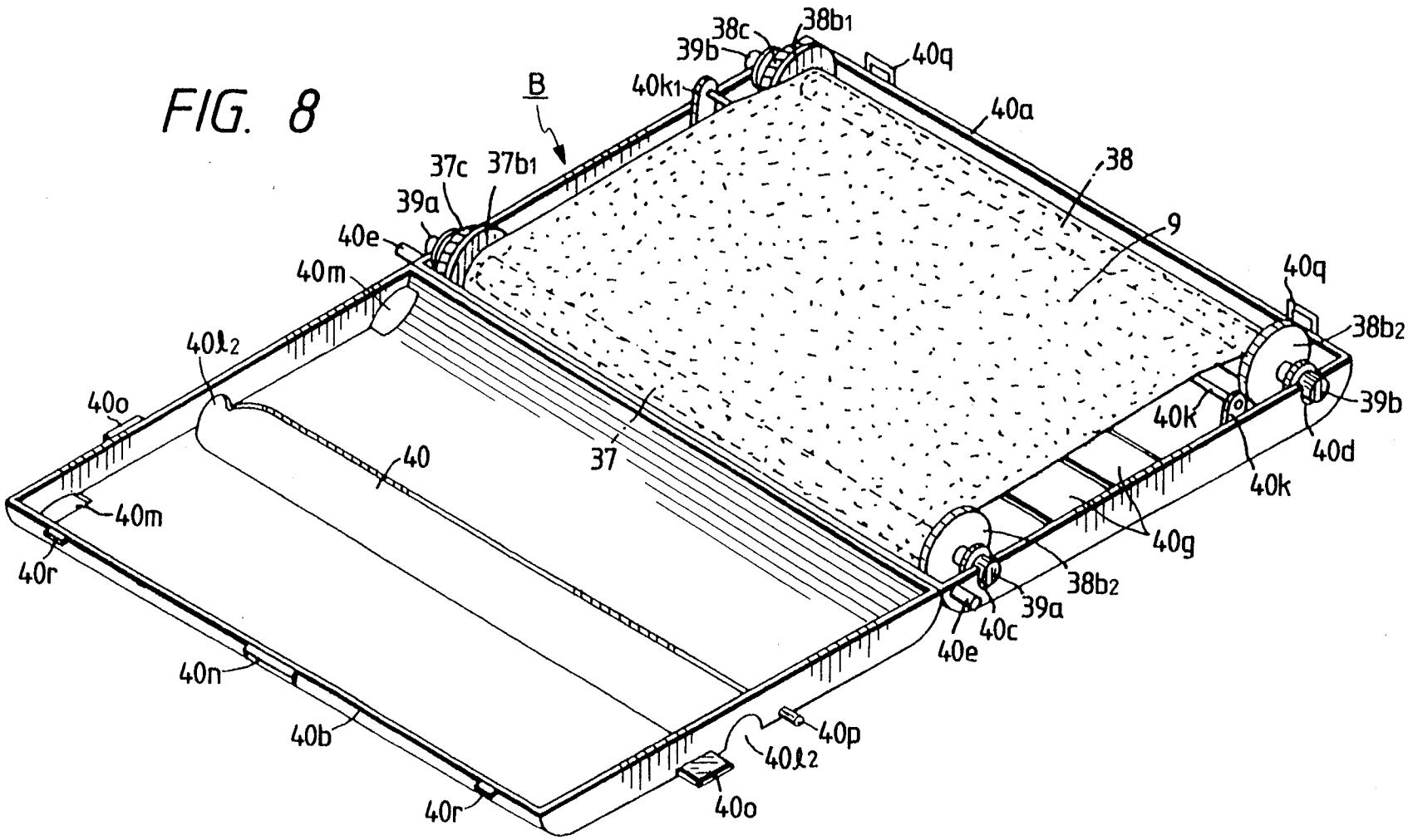

The first housing 40*a* is such that side plates $40a_2$ are erectly provided on the opposite sides of a base plate $40a_1$ having arcuate end portions, and two pairs of left and right U-grooves 40*c* and 40*d* are formed at predetermined locations on the side plates $40a_2$ at a predetermined interval. The bearings 39*a* of the supply reel 37 fit in the U-grooves 40*c* and the bearings 39*b* of the take-up reel 38 fit in the U-grooves 40*d*, whereby the first housing 40*a* is loaded with the supply reel 37 and the take-up reel 38. The bearings 39*a* and 39*b*, as shown in FIG. 8, are inserted in the U-grooves 40*c* and 40*d* with more or less play (in the direction of height of the cartridge) relative to the U-grooves.

Guide pins 40*e* for mounting the ink cartridge B in the lid member 2 are projectedly provided on the extension linking the U-grooves 40*c* and 40*d* and at the ends of the side plates $40a_2$ which are adjacent to the hinge. These guide pins 40*e*, as will be described later, provide the pivot axis when the ink cartridge B is inserted into the lid member 2.

Figure 10:
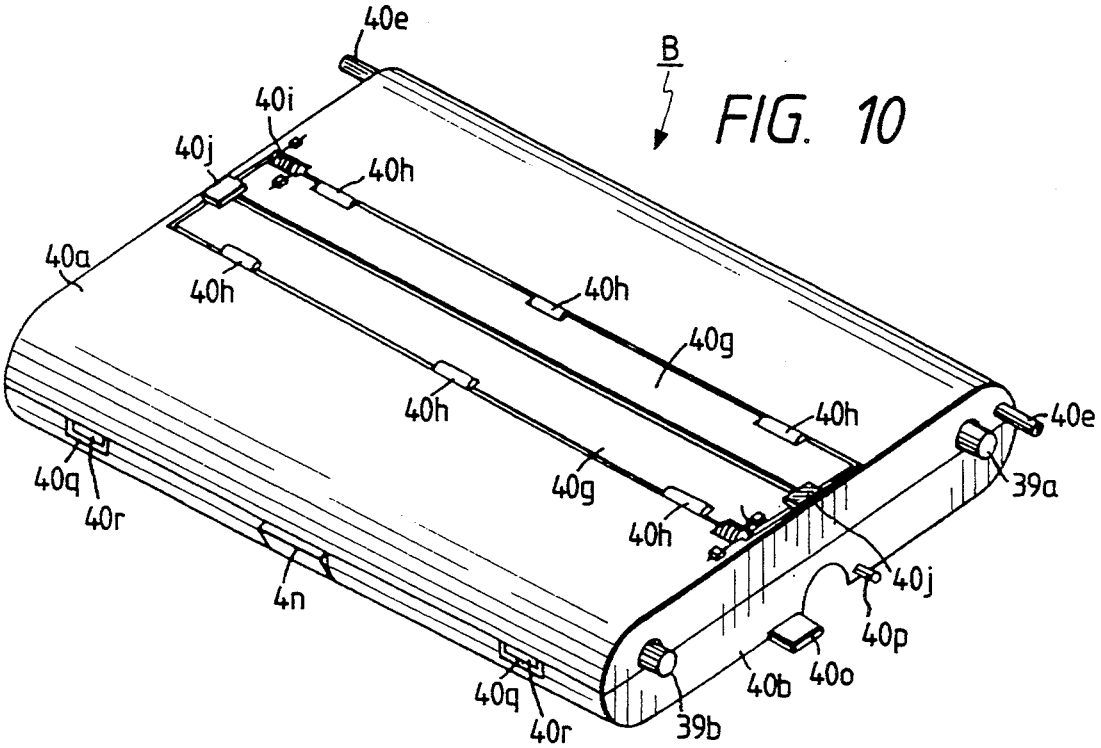

Further, an opening portion 40*f* for inserting the recording head 6*b* thereinto is provided at a predetermined location in the base plate $40a_1$, more specifically, substantially intermediately of the U-grooves 40*c* and 40*d*, and a French window type lid 40*g* is mounted on the opening portion 40*f*. The construction of the French window type lid 40*g* is such that two lids 40*g* are pivotally mounted to the base plate $40a_1$ by means of hinges 40*h* and a torsion coil spring 40*i* is mounted on the end portion of each of the lids 40*g*. The lids 40*g* are biased outwardly from within the container by the springs 40*i*. At predetermined locations on the base plate $40a_1$, as shown in FIG. 10, there are provided controlling plates 40*j* for controlling the biasing of the lids 40*g* by the torsion coil springs 40*i*.

Further, rising pieces $40k_1$ are projectedly provides on the inner walls of the two side plates $40a_2$ which are adjacent to the location at which the take-up reel 38 is mounted, and a guide rod 40*k* for guiding the conveyance of the ink sheet 9 as will be described later is provided between the rising pieces $40k_1$.

On the other hand, the second housing 40*b*, like the aforedescribed first housing 40*a*, is such that side plates $40b_2$ are erectly provided on the opposite sides of a base plate $40b_1$ having arcuate end portions and a window portion $40l_1$ for inserting the platen roller 6*a* thereinto when the lid member 2 is closed after the ink cartridge B is inserted into the lid member 2 is provided substantially centrally of the base plate $40b_1$. Cut-aways $40l_2$ for permitting the shaft of the platen roller to escape are formed in the side plates $40b_2$ continuously to the window portion $40l_1$.

Figure 9:
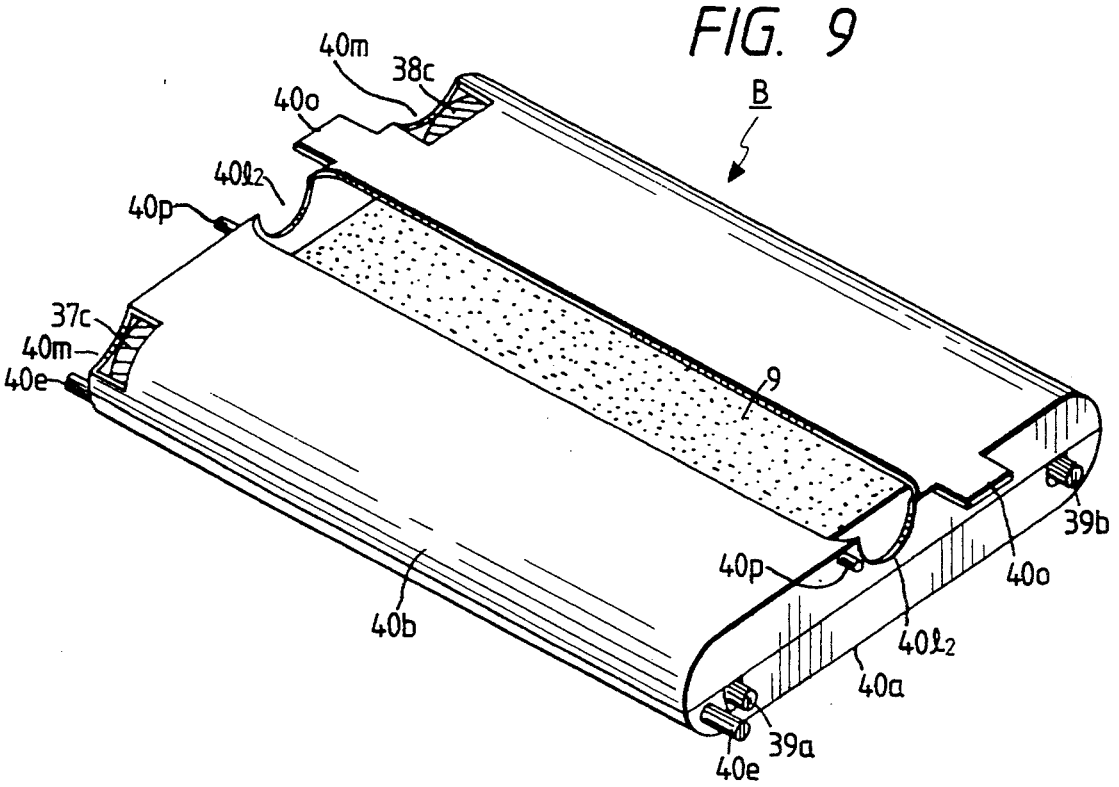

Also, as shown in FIG. 9, openings 40*m* for exposing therethrough the gears 37*c* and 38*c* of the supply reel 37 and take-up reel 38 contained in the container 40 are formed at predetermined locations in the base plate $40b_1$. The gears 37*c* and 38*c* exposed through these openings 40*m* are connected to an intermediate gear (not shown) and a motor (not shown) mounted in the apparatus body 1, whereby a rotational force is transmitted to the supply reel 37 and the take-up reel 38.

Further, a restraining projection 40*n* is projectedly provided at a predetermined location on the open side end portion of the second housing 40*b*. This restraining projection 40*n* is restrained by the restraining spring of the lid member 2 which will be described later, whereby the lid member 2 is loaded with the ink cartridge B. Also, outwardly protruding handles 40*o* are provided on the side plates $40b_2$ of the second housing 40*b*. So, when removing the ink cartridge B inserted in the lid member 2, the handles 40*o* may be gripped to release the restrained state of the restraining projection 40*n* with respect to the restraining spring.

Also, outwardly protruding pins 40*p* are projectedly provided on the side plates $40b_2$ of the second housing 40*b*, and are adapted to be restrained by restraining projections 24*b* projectedly provided on the decurling holding members 24 when the lid member 2 is loaded with the ink cartridge B.

Further, engagement recesses 40*q* are formed in the open side end portion of the first housing 40*a*, and engagement projections 40*r* for engagement with the engagement recesses 40*q* are provided on the open side end portion of the second housing 40*b*. So, when the two housings 40*a* and 40*b* are closed, the engagement projections 40*r* come into engagement with the engagement recesses 40*q* to thereby maintain the closed state.

When the ink sheet 9 is to be contained in the container 40 of the above-described construction, as shown in FIG. 8, the bearings 39*a* and 39*b* are fitted to the opposite ends of the supply reel 37 and take-up reel 38 on which the ink sheet 9 is wound, and then the bearings 39*a* and 39*b* are fitted into the U-grooves 40*c* and 40*d* of the first housing 40*a*. At this time, as shown in FIG. 8, the ink sheet 9 is set so as to be wound on the take-up reel 38 from above to below (that is, wound so that the take-up reel 38 may rotate clockwise as viewed in FIG. 8 to thereby take up the ink sheet 9). If this is done, when the ink sheet 9 is broken away, it will become easy to attach the leading end of the ink sheet 9 to the take-up reel 38 by means of a tape or the like.

Since the ink cartridge B, as shown in FIG. 10, has the lids 40*g* provided in the opening portion 40*f* for inserting the recording head thereinto, the entry of dust or the like into the cartridge B can be prevented during the custody or transportation thereof and the ink sheet 9 can be prevented from being injured.

Description will now be made of loading means constructed in the lid member 2 for loading the recording apparatus body with the ink cartridge B.

As shown in FIG. 1, mounting plates 41 formed laterally symmetrically are provided on the opposite sides of the lid member 2. Each of these mounting plates 41 is formed with a hook-shaped groove 41*a* for restraining the guide pin 40*e* of the ink cartridge B, and U-grooves 41*b* and 41*c* for fitting to the bearings 39*a* and 39*b* fitted to the opposite ends of the reels 37 and 38 and positioning the bearings 39*a* and 39*b*, the grooves 41*a*, 41*b* and 41*c* being disposed substantially on the same extension at predetermined intervals. Each of the mounting plates 41 is further provided with a positioning member 41*d* for positioning the decurling holding members 24 and a controlling projection 41*e* for controlling the rotation of the decurling holding members 24.

Also, near the open side end portion of the lid member 2, there is provided a restraining spring 42 for restraining the restraining projection 40*n* of the ink cartridge B.

Figure 11:
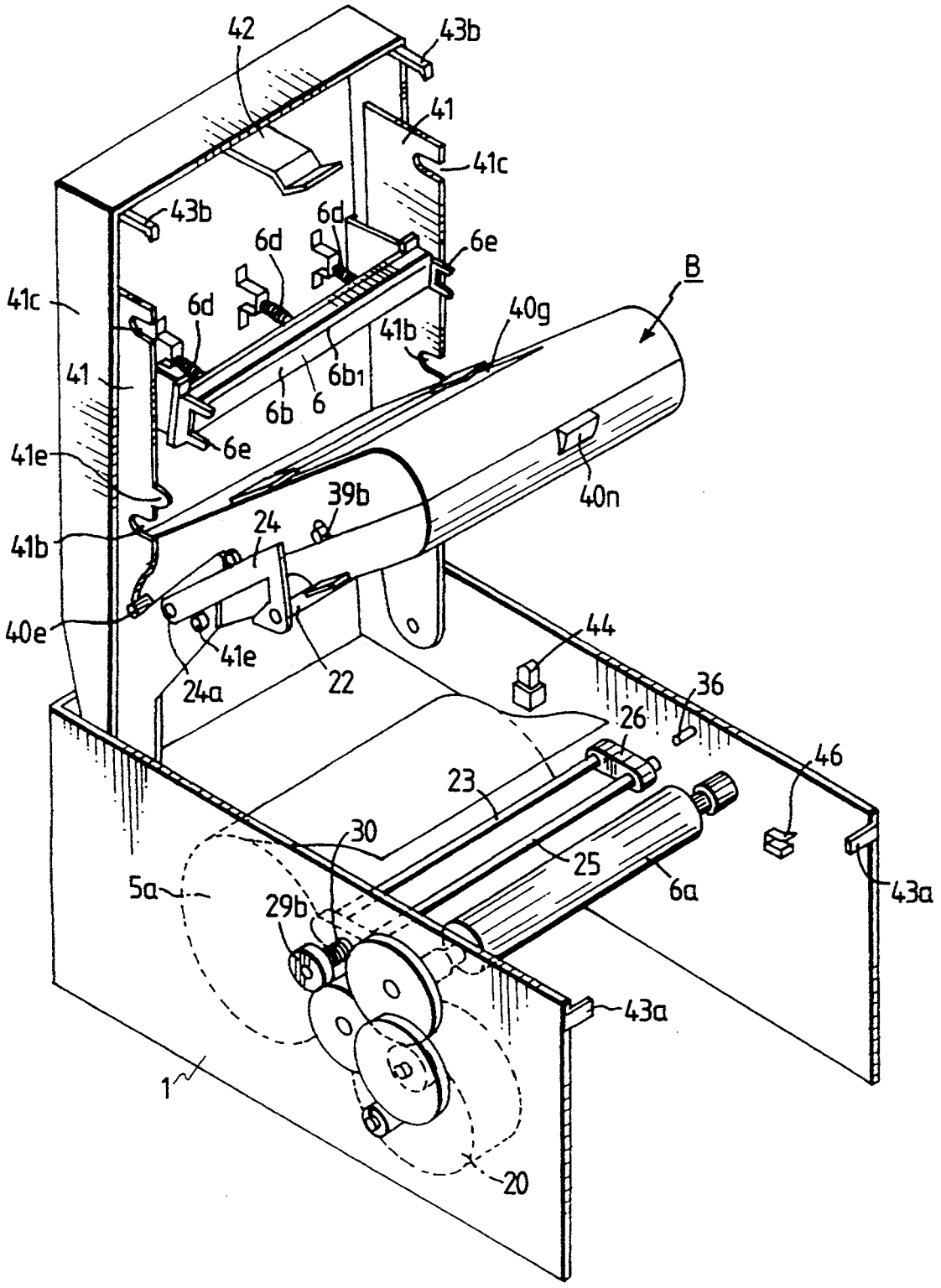
FIG. 11 and 12 illustrate a case where the apparatus is loaded with the ink sheet cartridge.

To load the lid member 2 of the recording apparatus body with the ink cartridge B, the lid member 2 is first opened substantially perpendicularly to the apparatus body 1, as shown in FIGS. 1 and 11. At this time, the decurling holding members 24 rotate due to their weight until they bear against the controlling projections 41*e*, and the decurling shaft 22 separates greatly from the inner top surface of the lid member 2.

Thereby the ink cartridge B is placed onto the decurling shaft 22, and is slided with the shaft 22 as a guide rail, and as shown in FIG. 11, the guide pins 40*e* are fitted into and restrained in the hook-shaped grooves 41*a* formed in the mounting plates 41. At this time, the pins 40*p* of the cartridge B come under the projections 24*b* of the decurling holding members 24.

Figure 12:
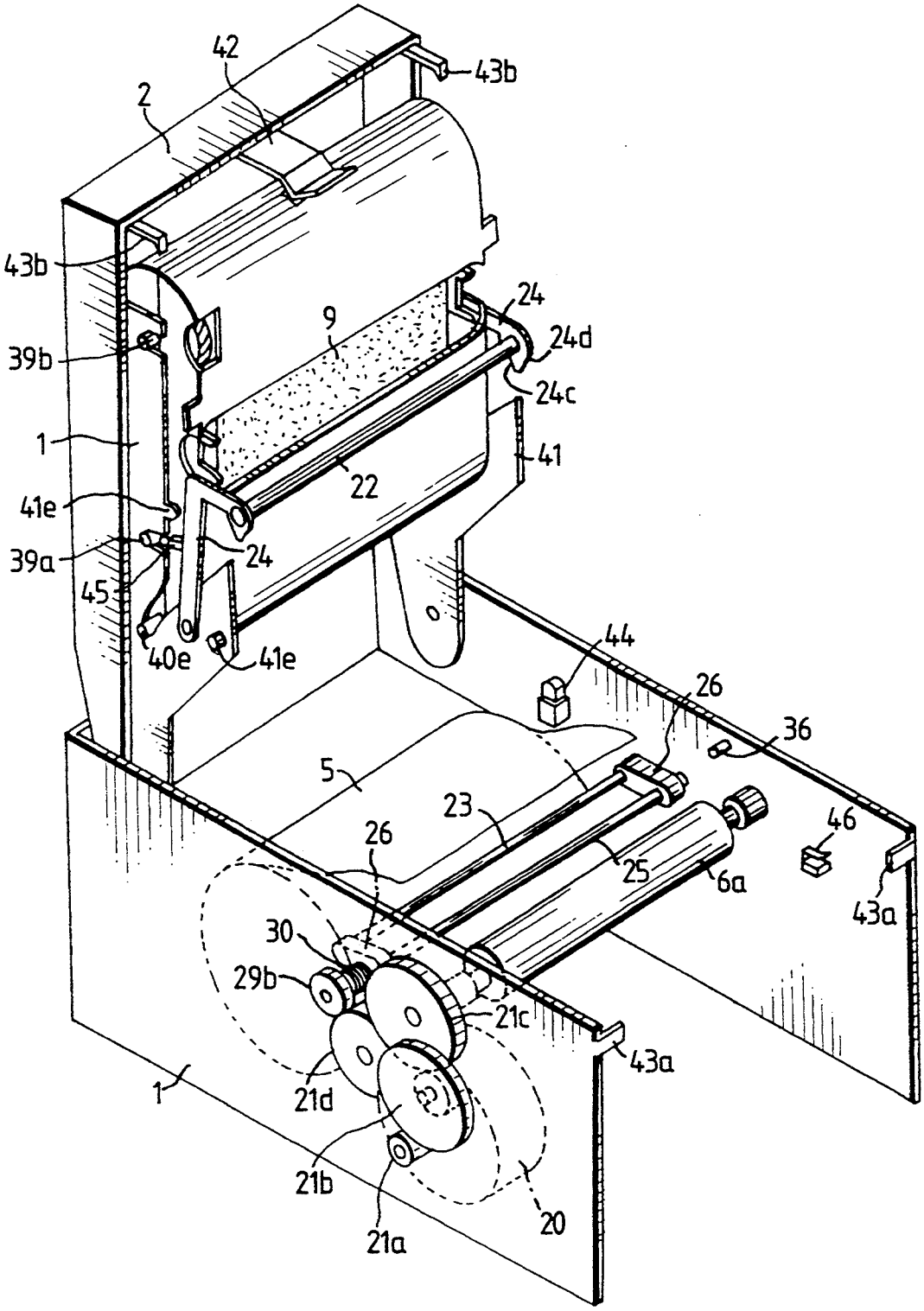

In this state, the ink cartridge B is rotated about the guide pin 40*e*, and as shown in FIG. 12, the restraining projection 40*n* is restrained by the restraining spring 42, whereby the lid member 2 is loaded with the ink cartridge B. Since at this time, the pins 40*p* of the ink cartridge B are under the projections 24*b* of the decurling holding members 24, the decurling holding members 24 also rotates following the rotation of the ink cartridge B. Accordingly, after the lid member 2 has been loaded with the ink cartridge B, the spacing between the decurling shaft 22 and the body 1 becomes great as shown in FIG. 12 and therefore, the interchange of the recording sheet 5 can be done easily.

Also, when the lid member 2 is to be loaded with the ink cartridge B, as shown in FIG. 3, fork members 6*e* mounted on the opposite ends of the recording head 6*b* push open the lids 40*g* of the ink cartridge B against the biasing force of the torsion coil spring 40*i* and the recording head 6*b* is inserted into the cartridge.

The biasing force exerted on the lids 40*g* by the torsion coil spring 40*i* (the force which tends to bring the lids 40*g* back to their closed state) is set to such a degree of force that when as shown in FIG. 3, the lid member 2 is closed and the recording head 6*b* is brought into pressure contact with the platen roller 6*a*, this pressure contact force is not affected.

In the aforedescribed construction, the guide pin 40*e* of the ink cartridge B and the U-grooves 40*c* and 40*d* into which the bearings 39*a* and 39*b* are fitted are disposed on a straight line. Therefore, when the ink cartridge B is rotated about the guide pin 40*e*, the bearings 39*a* and 39*b* of the supply reel 37 and take-up reel 38 are positioned relative to the U-grooves 41*b* and 41*c* of the mounting plates 41 substantially at a time. Thus, the bearings 39*a* and 39*b* are reliably positioned relative to and fitted in the U-grooves 41*b* and 41*c* of the mounting plates Also, the guide pin 40*e* of the ink cartridge B and the U-grooves 40*c* and 40*d* into which the bearings 39*a* and 39*b* are fitted are disposed on a straight line on that side of the container 40 which is adjacent to the first housing 40*a*, and the hook-shaped grooves 41*a* and U-grooves 41*b*, 41*c* of the mounting plates 41 for positioning these are also disposed on a straight line and therefore, the bearings 39 are accurately positioned relative to the guide pin 40*e*. That is, simply by the hook-shaped grooves 41*a* and U-grooves 41*b*, 41*c* being disposed on a straight line on the mounting plates 41, the positioning accuracy of the bearings 39 can be enhanced.

Further, by the guide pin 40*e* being provided on the endmost portion of the ink cartridge B, there is seperated by a distance from the guide pin 40*e* which provides the pivot axis to the opening portion 40*f*, whereby it becomes possible to make the size of the opening portion 40*f* substantially equal to the minimum size necessary to insert the recording head 6.

When in the manner described previously, the ink cartridge B is mounted in the lid member 2 and the lid member 2 is closed with the hook 43*a* of the apparatus body 1 restrained to the hook 43*b* of the lid member 2, the decurling holding members 24 are positioned.

The positioning construction for the decurling holding members 24 will now be described. As shown in FIGS. 3 and 4, holding member pressing means 44 for pressing the decurling holding members 24 upwardly is provided at a predetermined location in the body 1. A pressing member 44*b* biased upwardly against the apparatus body 1 by a spring 44*a* is attached to the pressing means 44. So, when the lid member 2 with the ink cartridge B mounted therein is closed, the pressing member 44*b* presses the decurling holding members 24. Thereby, the decurling holding members 24 bear against a positioning member 41*d* and is positioned.

Also, support shaft pressing means 45 for pressing a support shaft 39*a* upwardly is provided at a predetermined location on the decurling holding members 24. This support shaft pressing means 45 is comprised of a pressing member 45*b* also biased upwardly by a spring 45*a*. The pressing member 45*b* is mounted at a location where it bears against the support shaft 39*a* mounted on the opposite ends of the supply reel 37 when the lid member 2 is closed. Accordingly, when the lid member 2 is closed and the decurling holding members 24 are pressed upwardly by the holding member pressing means 44, the support shaft 39*a* will be urged against the U-groove 40*c* by the support shaft pressing means 45 and reliably positioned..

The biasing force of the holding member pressing means 44 is set so as to exert a torque greater than the torque exerted by the support shaft pressing means 45. That is, it is set so that $f_1 \times l_1 > f_2 \times l_2$, where $f_1$ is the biasing force of the spring 44*a* of the holding member pressing means 44, $l_1$ is the distance from the shaft 24*a* which provides the pivot axis of the decurling holding members 24 to the location at which the pressing member 44*b* bears against the support shaft 39*a*, $f_2$ is the biasing force of the spring 45*a* of the support shaft pressing means 45, and $l_2$ is the distance from the shaft 24*a* to the pressing member 45*b*. Thereby, when the lid member 2 is closed, the decurling holding members 24 will reliably bear against the positioning member 41*d*.

Also, at a predetermined location in the apparatus body 1, a spring member 46 which provides the pressing member is mounted in opposed relationship with support shafts 39*b* mounted on the opposite ends of the take-up reel 38 in the ink cartridge. B mounted in the lid member 2, as specifically shown in FIG. 12, and when the lid member 2 is closed, the bearing 39*b* will be pressed by the spring member 46 and positioned thereby.

In the manner described previously, the bearings 39*a* and 39*b* are positioned in the U-grooves 41*b* and 41*c* of the mounting plates 41, and the positioning when loading the lid member 2 with the ink cartridge B and the positioning of the bearings 39*a* and 39*b* are independent of each other. Thus, the bearings 39*a* and 39*b* are directly positioned in the apparatus body 1 without the intermediary of the ink cartridge B, and the accuracy with which of the reels 37 and 38 are held parallel to the platen roller 6*a* is enhanced. Also, it is unnecessary to control the positional accuracy of the bearings 39 of the ink cartridge B by the dimensions of cartridge B and therefore, it is unnecessary that the cartridge B passes great rigidity and accuracy. Thus, it becomes possible to manufacture the ink cartridge at a low cost.

Description will now be made of a case where recording is effected by the recording system C in which the ink cartridge B has been mounted in the manner described previously. In this embodiment, description will be made chiefly of the decurling actions when the diameter of the roll is large as shown in FIG. 5 and when the diameter of the roll is small as shown in FIG. 6.

When a recording start signal is input, the motor 20 rotates in a forward direction to thereby rotate the platen roller 6a in the direction of arrow d, whereby the recording sheet 5 and the ink sheet 9 are conveyed in the direction of arrow e. In synchronism with this conveyance, the heat generating elements 6b, of the recording head 6 selectively generate heat, and in response thereto, the ink is transferred from the ink sheet 9 to the recording sheet 5, whereby predetermined recording is effected on the recording sheet 5. When the recording sheet 5 is conveyed, the decurling mechanism A is operated to cure the recording sheet 5 of its curl.

That is, the forward drive force of the motor 20 is also transmitted to the clutch gear 29, but as previously described, the spring clutch 30 becomes free and the clutch gear 29 idly rotates relative to the clutch flange 28.

On the other hand, by the tension force of the tension spring 35, a biasing force in the direction of arrow f is acting on the shaft 25 as shown in FIG. 5 and therefore, the arm 26 is rotated in the direction of arrow -b, whereby the guide shaft 23 is moved, and is stopped at a position whereat it is balanced with the tension of the recording sheet 5.

Thus, the conveyance path of the recording sheet 5 becomes such that the recording sheet 5 unwinds from the sheet roll 5a to the guide shaft 23 in the direction of curl, and then is bent by the decurling shaft 22 and winds around the shaft 22 in the direction opposite to the direction of curl. By such winding of the recording sheet 5 around the decurling shaft 22, the recording sheet 5 is cured of its curl.

Here, as regards the tension exerted on the recording sheet 5 being conveyed, the contact friction between the roll holder 4 and the roll 5a placed in the holder 4 acts on the recording sheet 5. That is, when as shown in FIG. 3, the weight of the roll 5a is $G_1$ and the tension acting on the recording sheet 5 at this time is $F_1$, the tension $F_1$ acts along the recording sheet 5 forwardly and rearwardly of the guide shaft 23. Also, by the guide shaft 23 being moved in the direction of arrow -b, the amount of the recording sheet wound around the shaft 23 is increased. So correspondingly thereto, the drag to the rotational force of the arm 26 (the rotational torque, about the pulley 33 produced by the tensile force of the tension spring 35) relative to the resultant force of the tension $F_1$ is increased. The arm 26 is then stopped at a position whereat this resultant force is balanced with the rotational force of the arm 26.

When the diameter of the roll is large as shown in FIG. 3, the angle $\theta_1$ at which the recording sheet 5 winds around the decurling shaft 22 when the tension $F_1$ to the recording sheet 5 is balanced with the rotational force of the arm 26 is $\theta_1$, whereafter the recording sheet is directed to the platen roller 6a.

On the other hand, when the diameter of the roll 5a becomes smaller as shown in FIG. 4, the weight $G_2$ of the roll also becomes smaller ($G_2<G_1$), and the tension $F_2$ acting on the recording sheet 5 also becomes smaller ($F_2<F_1$). Therefore, the arm 26 is rotated more in the direction of arrow -b than when the diameter of the roll is large. When the rotational force of the arm 26 becomes balanced with this drag, the arm 26 is stopped at that position, but when the amount of rotation of the arm 26 is greater, the arm 26 is stopped at a position whereat it bears against the stopper 36. The angle at which the recording sheet 5 winds around the decurling shaft 22 at this time is $\theta_2$, which is smaller than the corresponding angle $\theta_1$ when the diameter of the roll is large.

Accordingly, when the diameter of the roll 5a is large, the amount of the recording sheet wound about the decurling shaft 22 is small, and as the diameter of the roll becomes smaller and the curl becomes stronger, the amount winding becomes greater. As the amount of winding becomes greater, the recording sheet 5 is bent more in the direction opposite to the direction of curl and therefore, the curl curing effect is enhanced. That is, as the diameter of the roll decreases causing the curl to become stronger, then; curl curing effect becomes greater.

Thus, the decurling mechanism A has its decurling effect changed by the balance between the tension acting on the recording sheet 5 and the rotational force of the arm 26 in conformity with the strength of the curl, thereby appropriately curing the recording sheet of its curl.

Also, the biasing of the arm 26 is accomplished by the tension spring 35, and the rotational force of the motor 20 is transmitted to the platen roller 6a, but not to the arm 26. Accordingly, a load for moving the arm 26 is not imposed on to the motor 20 during recording and therefore, the accuracy of conveyance is enhanced and recording of images or high quality can be accomplished.

After images have been recorded on the recording sheet 5 which has been cured of its curl in the manner described previously, the recording sheet 5 is cut by the cutter 7 and is discharged by the discharge rollers 8.

On the other hand, the portion of the recording sheet 5 which is in the apparatus has its leading end retracted by the distance l from the cutter 7 to the recording means 6. This is for the purpose of preventing a blank portion from being created at the leading end of the sheet during the next recording. Therefore, when the motor 20 is driven by a predetermined amount in the reverse direction, the drive force thereof is transmitted not only to the platen roller 6a but also to the clutch flange 28 because the spring clutch 30 is now in its locked condition as previously described, and a force for rotating the arm 26 in the direction of arrow b acts on the arm.

At this time, as shown in FIG. 5, the tensile force of the tension spring 35 is acting on the arm 26 in a direction to preclude this rotation. Therefore, in the motor 20 in the present embodiment, the drive force when it is driven in the reverse direction as previously mentioned is set to a value greater than the arm rotating force by the tensile force of the tension spring 35.

Accordingly, when the motor 20 is driven in the reverse direction to convey the recording sheet 5 in the reverse direction as previously mentioned, the arm 26 is rotated in the direction of arrow b by the drive force of the motor 20 and is spaced apart from the recording sheet 5, and returns to its initial position indicated by the dotted and dashed line in FIGS. 3 and 4. Here, the initial position refers to a position in which the guide shaft 23 does not close the opening portion of the roll holder 4 and in which the guide shaft 23 does not interfere with the decurling shaft 22 when the lid member 2 is opened. In this state, the guide shaft 23 is spaced apart from the recording sheet 5 and therefore, even if the recording standby state continues long, curl in the opposite direction will not be produced in the recording sheet 5.

The amount by which the arm 26 is rotated when the motor 20 is driven in the reverse direction to convey the recording sheet 5 by the distance l in the reverse direction is set to the angle at which the arm 26 is rotated from the position in which it bears against the stopper 36 to the initial position, as shown in FIG. 4.

The motor 20 is stopped after the recording sheet 5 has been rewound by a predetermined amount l, but at this time, the arm 26 is being pulled by the tension spring 35. This tensile force, as shown in FIG. 5, tends to rotate the pulley 33 in the direction of arrow f and therefore, becomes a force which biases the clutch gear 29 in the direction of arrow a with the spring clutch 30 becoming locked, and this force produces a rotational torque which rotates the motor 20 through the gears 21*a*–21*d*.

For example, when the rotational torque which rotates the pulley 33 in the direction of arrow f is $T_1$ (e.g. about 1 kg.cm), if the ratio between the numbers of rotations of the motor 20 and the clutch gear 29 is 10:1, the rotational torque $T_2$ transmitted to the motor 20 by said rotational force is $T_1/10$ (0.1 kg.cm).

So, in the present embodiment, in order to prevent the arm 26 from being rotated when the motor 20 is stopped, the self-holding torque of the motor 20 (the maximum external torque which can be applied to a rotor comprising a permanent magnet which tends to be stopped by the magnetic force or the like without moving the rotor) is set to a value 8 (e.g. 0.2 kg.cm) greater the an the rotational torque $T_2$ transmitted to the motor 20.

Thereby, in the recording apparatus the present embodiment, in the recording standby state, the arm 26 is held in its initial position indicated by the dotted and dashed line in FIGS. 3 and 4.

Accordingly, when the lid member 2 is opened to change the roll 5*a*, the guide shaft 23 will not interfere with the decurling shaft 22 and the lid member 2 can be opened smoothly.

In the present embodiment, even when as shown in FIG. 4, the guide shaft 23 comes round above the decurling shaft 22 and fails to return to its initial position due to interruption in the power supply or the like, the lid member 2 can be opened smoothly.

That is, the tip ends of the decurling holding members 24, as shown in FIG. 4, are formed into a tapered shape by a leftwardly downwardly inclined upper guide portion 24*c* and a rightwardly downwardly inclined lower guide portion 24*d*. Accordingly, when the lid member 2 is opened from the state shown in FIG. 4, the upper guide portion 24*c* will bear against the guide shaft 23 with the upward movement of the decurling holding members 24 and the guide shaft 23 will be retracted along the taper of the upper guide portion 2*c*.

Also, when the guide shaft 23 is stopped in the position of FIG. 4 with the lid member 2 opened, if the lid member 2 is closed, the lower guide portion 24*d* will bear against the guide shaft 23 with the downward movement of the decurling holding members 24 and the guide shaft 23 will be retracted along the taper of the lower guide portion 24*d*.

Accordingly, even if the guide shaft 23 is not in its initial position, the lid member 2 can be opened or closed smoothly without interference between the decurling shaft 22 and the guide shaft 23 when the lid member 2 is opened or closed.

Description will now be made of a case where the ink cartridge B is interchanged or removed from the lid member 2. When as shown in FIG. 12, the lid member 2 is opened and the ink cartridge B is pulled on with the handle 40*o* thereof gripped, the engagement between the restraining projection 40*n* of the ink cartridge B and the restraining spring 42 is released. The handle 40*o* and the restraining projection 40*n* are both provided on the second housing 40*b* and therefore, even if the handle 40*o* is pulled on at this time, no force will be exerted on the portion of engagement between the first housing 40*a* and the second housing 40*b*, i.e., the portion of engagement between the engagement recesses 40*q* and the engagement projections 40*r*, and the two housings 40*a* and 40*b* will not open.

Then the cartridge B is pulled out toward this side with the decurling shaft 22 as a guide rail as when loading the lid member 2 with the cartridge B, whereby the cartridge B can be easily removed from the lid member 2.

In the apparatus of the present embodiment which is constructed as described previously, curl curing by a degree corresponding to the extent of curl can be accomplished, and since the load exerted on the motor 20 during recording is only the load for rotating the platen roller 6*a*, sheet conveyance can be accomplished accurately and further, the interchange of the roll 5*a* or the like can be done easily. Also, when interchanging the ink sheet 9, the ink cartridge B can be interchanged easily with the positioning or the like thereof accomplished reliably.

[Other Embodiments]

In the aforedescribed embodiment, the guide shaft 23 is mounted on the arm 26 and is designed to be moved by this arm being rotated, whereas said moving means need not be restricted thereto, but alternatively, for example, the guide shaft 23 may be designed to be moved along and parallel to a rack or s rail, or may be designed to be moved by being pushed up by s cam or the like.

Also in the aforedescribed embodiment, the spring clutch 30 is used as the means for selectively transmitting the drive force of the motor to the decurling shaft 22, but said means is not restricted thereto, and use may be made, for example, of a needle clutch or ratchet of the roller type, or an electromagnetic clutch or the like which can change over the transmission and release of the drive force by a signal from a control unit.

Further in the aforedescribed embodiment, the motor 20 for driving the platen roller 6*a* is used as the drive source for moving the guide shaft 23, but of course, design may be made such that the platen roller and the guide shaft are driven by separate motors. Furthermore, the drive source need not be limited to s motor, but for example, a plunger or the like may also be used.

Still furthermore, in the aforedescribed embodiment, a tension spring is used as the biasing means for biasing the decurling shaft 22 in a direction to enhance the decurling effect, whereas the present invention need not be restricted thereto, but for example, use may be made of a cylinder such as an air cylinder or an oil cylinder, or a magnet, besides a spring such as a torsion coil spring, a compression spring or a spiral spring.

Also, in the aforedescribed embodiment, the tip ends of the decurling holding members 24 are designed to bear against the guide shaft 23, but alternatively, it may be designed not to bear, but to be retracted.

In the present embodiment, as previously described, the decurling member is mounted on the lid member through the decurling holding members and therefore, the accuracy of the positioning of the decurling member relative to the apparatus body can be made constant irrespective of the dimensioned accuracy of the ink cartridge. Accordingly, the part accuracy of the ink cartridge is not strictly required and therefore, it becomes possible to manufacture the ink cartridge at a low cost.

Also, the holding member pressing means for pressing the decurling holding members against the lid member side is provided in the apparatus body and the positioning member for positioning the decurling holding members relative to the apparatus body is provided on the lid member, whereby when the lid member is closed, the decurling holding members are pressed against and fixed to the positioning member by the holding member pressing means and thus, the positioning of the decurling member relative to the apparatus body can be made reliable.

Further, the support shaft pressing means for pressing the support shaft of the reel on which the ink sheet is wound against the lid member side is provided on the decurling holding members and design is made such that the pressure force of the holding member pressing means becomes greater than the pressure force of the support shaft pressing means, whereby it becomes possible to make the positioning of the support shaft of the reel more accurate.

Also, the decurling holding members are pivotable relative to the lid member and therefore, when loading the lid member with the ink cartridge, the decurling member can be greatly spaced apart from the inner surface of the lid member to thereby easily load the lid member with the ink cartridge. Making the spacing between the decurling holding members greater than the width of the ink cartridge, the decurling holding members can be pivotally moved to space the decurling member apart from the inner surface of the lid member, and when loading the lid member with the ink cartridge, the decurling member can be made to function as a guide therefor to thereby easily load the lid member with the ink cartridge.

Further, design is made such that the decurling member and the guide member do not interfere with each other when the lid member is opened, whereby the opening of the lid member can be effected smoothly.

As described above, according to the present invention, there can be provided a recording apparatus which is markedly improved in operability.

We claim:

1. A recording apparatus for recording an image on a recording sheet, the apparatus comprising:

an apparatus body;

a lid member openable and closable relative to said apparatus body;

an ink sheet cartridge loading portion for loading an ink sheet cartridge containing an ink sheet on a mounting section of said lid member; and a decurling mechanism having a guide member mounted on said apparatus body, a holding member rotatably mounted on said lid member and a decurling member, said decurling mechanism guiding a recording sheet being conveyed so as to be bent in a first direction opposite to a second direction of a curl of the recording sheet by said decurling member and said guide member, and said holding member rotatably holding said decurling member with respect to said lid member and guiding said ink sheet cartridge to said mounting section of said lid member when said ink sheet cartridge is mounted on said mounting section between said decurling member and said lid member.

2. A recording apparatus according to claim 1, wherein said apparatus is a facsimile apparatus.

3. A recording apparatus according to claim 1, wherein an inner surface of said curl is wound on the guide member of said decurling mechanism and an outer surface of said curl is wound on the decurling member of said decurling mechanism so that said curl of said recording sheet is wound around said decurling member to correct said curl.

4. A recording apparatus according to claim 5, further including biasing means for biasing said guide member, said biasing means varying a winding amount of said recording sheet wound on said decurling member wherein said winding amount determines a force for bending said curl in a reverse direction in accordance with a magnitude of said curl, and wherein said winding amount is varied so that said force increases in accordance with said magnitude.

5. A recording apparatus according to claim 4, wherein said magnitude varies in accordance with a rotation initial load responsive to a change of a diameter of a roll of said recording sheet stocked in a roll shape.

6. A thermal transfer recording apparatus for recording on a recording medium, said apparatus comprising:

an apparatus body;

a lid member openable and closable relative to said apparatus body;

an ink sheet cartridge loading portion for loading an ink sheet cartridge containing an ink sheet on a mounting section of said lid member;

a conveying mechanism for conveying the recording medium;

a recording head for transferring ink of said ink sheet by applying heat to said ink sheet to transfer the ink onto said recording medium so as to record on said recording medium;

a decurling mechanism having a guide member mounted on said apparatus body, a holding member rotatably mounted on said lid member and a decurling member, said decurling mechanism. guiding a recording sheet being conveyed so as to be bent in a first direction opposite to a second direction of a curl of the recording sheet by said decurling member and said guide member, and said holding member rotatably holding said decurling member with respect to said lid member and guiding said ink sheet cartridge to said mounting section of said lid member when said ink sheet cartridge is mounted on said mounting section between said decurling member and said lid member; and a drive force source for driving said conveying mechanism and selectively releasing said decurling mechanism from correcting said curl of said recording sheet.

7. A thermal transfer recording apparatus according to claim 6, wherein said apparatus is a facsimile apparatus.

8. A thermal transfer recording apparatus according to claim 6, wherein an inner surface of said curl is wound on the guide member of said decurling mechanism and an outer surface of said curl is wound on the decurling member of said decurling mechanism so that said curl of said recording sheet is wound around said decurling member to correct said curl.

9. A thermal transfer recording apparatus according to claim 8, further including biasing means for biasing said guide member, said biasing means varying a winding amount of said recording sheet wound on said decurling member wherein said winding amount determines a force for bending said curl in a reverse direction in accordance with a magnitude of said curl, and wherein said winding amount is varied so that said force increases in accordance with said magnitude.

10. A thermal transfer recording apparatus according to claim 9, wherein said magnitude varies in accordance with a rotation initial load responsive to a change of a diameter of a roll of said recording sheet stocked in a roll shape.

* * * * *

UNITED STATES PATENT AND TRADEMARK OFFICE

CERTIFICATE OF CORRECTION

PATENT NO. : 5,450,102

DATED : September 12, 1995

INVENTOR(S) : YASUSHI ISHIDA, ET AL.

It is certified that error appears in the above-identified patent and that said Letters Patent is hereby corrected as shown below:

COLUMN 1

Line 64, "shaft 52" should read --shaft 54--.
Line 66, "curing" should read --"curing"--.

COLUMN 2

Line 8, "shaft 52" should read --shaft 54--.
Line 56, "PREFERRED" should read --THE PREFERRED--.
Line 65, "said" should read --the--.

COLUMN 3

Line 43, "an other" should read --another--.
Line 44, "Construction" should read --construction--.

COLUMN 4

Line 22, "$6b_1$," should read --$6b_1$--.
Line 25, "$6b_1$," should read --$6b_1$--.
Line 32, "cutter" should read --cutter having--.
Line 33, "specifically" should read --specifically,-- and "joined" should read --fixed--.
Line 34, "fixed" should read --joined--.
Line 47, "roll 5a, the" should read --roll 5a. The--.
Line 52, "severe severe," should read --severe,--.

COLUMN 5

Line 3, "is" (first occurrence) should read --in--.
Line 66, "gears 21a-21" should read --gears 21a-21c--.

UNITED STATES PATENT AND TRADEMARK OFFICE

CERTIFICATE OF CORRECTION

PATENT NO. : 5,450,102

DATED : September 12, 1995

INVENTOR(S) : YASUSHI ISHIDA, ET AL.

It is certified that error appears in the above-identified patent and that said Letters Patent is hereby corrected as shown below:

COLUMN 6

Line 31, "( a" should read --(a--.
Line 44, "(heat" should read --(heat- --.
Line 45, "heat sublimable)" should read --heat-sublimable)-
Line 48, "reel" should read --reel 38.--.
Line 61, "container The" should read --container 40. The--
Line 64, "container." should read --container--.

COLUMN 7

Line 7, "more or" should read --some--.
Line 8, "less" should be deleted.
Line 32, "provides" should read --provided--.

COLUMN 9

Line 12, "rotates" should read --rotate--.
Line 41, "plates" should read --plates 41.--.
Line 55, "sepe-" should read --sepa- --.

COLUMN 10

Line 9, "is" should read --are--.
Line 42, "cartridge." should read --cartridge--.
Line 56, "of" should be deleted.
Line 60, "passes" should read --possess--.

UNITED STATES PATENT AND TRADEMARK OFFICE

CERTIFICATE OF CORRECTION

PATENT NO. : 5,450,102

DATED : September 12, 1995

INVENTOR(S) : YASUSHI ISHIDA, ET AL.

It is certified that error appears in the above-identified patent and that said Letters Patent is hereby corrected as shown below:

COLUMN 11

Line 8, "6b," should read --6b--.
Line 44, "sheet" should read --sheet 5--.
Line 45, "So" should read --So,--.
Line 46, "torque," should read --torque--.

COLUMN 12

Line 9, "winding" should read --of winding--.
Line 13, "decreases" should read --decreases,--.
Line 14, "then;" should read --the--.

COLUMN 13

Line 29, "kg.cm" should read --kg-cm--.
Line 30, "the an" should read --than--.
Line 54, "portion 2c." should read --portion 24c.--.

COLUMN 14

Line 36, "s" should read --a--.
Line 37, "s" should read --a--.
Line 52, "s" should read --a--.

COLUMN 15

Line 3, "dimensioned" should read --dimensional--.
Line 4, "part" should read --dimensional--.
Line 33, "Making" should read --By making--.

UNITED STATES PATENT AND TRADEMARK OFFICE

CERTIFICATE OF CORRECTION

PATENT NO. : 5,450,102

DATED : September 12, 1995

INVENTOR(S) : YASUSHI ISHIDA, ET AL.

It is certified that error appears in the above-identified patent and that said Letters Patent is hereby corrected as shown below:

COLUMN 16

Line 13, "claim 5," should read --claim 3,--.
Line 17, "ber" should read --ber,--.

COLUMN 17

Line 5, "member" should read --member,--.

Signed and Sealed this

Nineteenth Day of March, 1996

Bruce Lehman

BRUCE LEHMAN

*Commissioner of Patents and Trademarks*

*Attest:*

*Attesting Officer*